United States Patent [19]

Bailey

[11] 4,391,201

[45] Jul. 5, 1983

[54] AQUATIC TOBOGGAN SLIDE

[76] Inventor: Kenneth I. Bailey, R.R. #2, Whitby, Ontario, Canada

[21] Appl. No.: 302,703

[22] Filed: Sep. 16, 1981

Related U.S. Application Data

[63] Continuation of Ser. No. 174,757, Aug. 4, 1980, abandoned, which is a continuation-in-part of Ser. No. 25,795, Apr. 2, 1979, abandoned.

[51] Int. Cl.[3] ..... B62B 13/06; A63G 21/18

[52] U.S. Cl. ..... 104/70; 272/56.5 R; 280/18; 441/65

[58] Field of Search ..... D12/11; 9/310 R, 310 B; 104/69, 70, 249; 280/18; 272/56.5 R, 56.5 SS

[56] References Cited

U.S. PATENT DOCUMENTS

| | | | |
|---|---|---|---|
| 1,467,293 | 9/1923 | Matheson | 104/70 |
| 1,594,444 | 8/1926 | Bernardy | 104/242 |
| 1,606,854 | 11/1926 | Vaszin | 104/70 |
| 3,512,195 | 5/1970 | Porsche | 9/310 |
| 3,690,265 | 9/1972 | Horibata | 104/70 |
| 3,865,391 | 2/1975 | Melnick et al. | 280/18 |
| 3,937,482 | 2/1976 | Johnson | 280/18 |
| 4,149,710 | 4/1979 | Rouchard | 272/56.5 R |

*Primary Examiner*—Richard A. Bertsch
*Attorney, Agent, or Firm*—Ridout & Maybee

[57] ABSTRACT

An aquatic toboggan slide has a trough like chute with side walls and a bed of closely spaced rollers, the toboggans discharging horizontally from the chute about 12–20 inches above a body of water so as to skip or plane over the water surface. The toboggans are of moulded plastic with a planing bottom surface and resilient seats spaced from the bottom surface to protect the user's spine against water impact shocks. The toboggans may be double walled and foam filled or single walled with transverse ribs in the bottom surface to stiffen the structure and enhance planing.

10 Claims, 7 Drawing Figures

FIG. 3
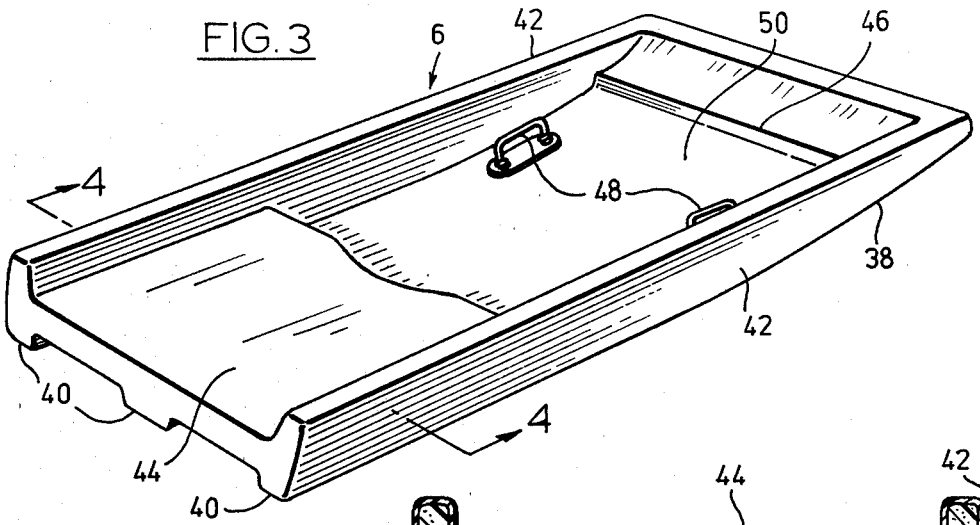
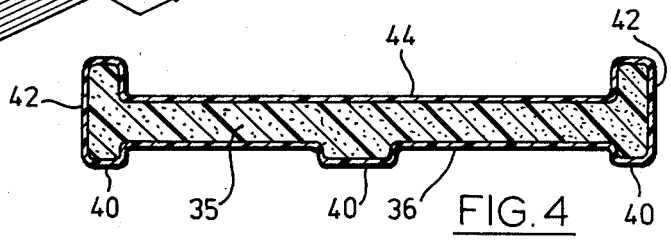
FIG. 4
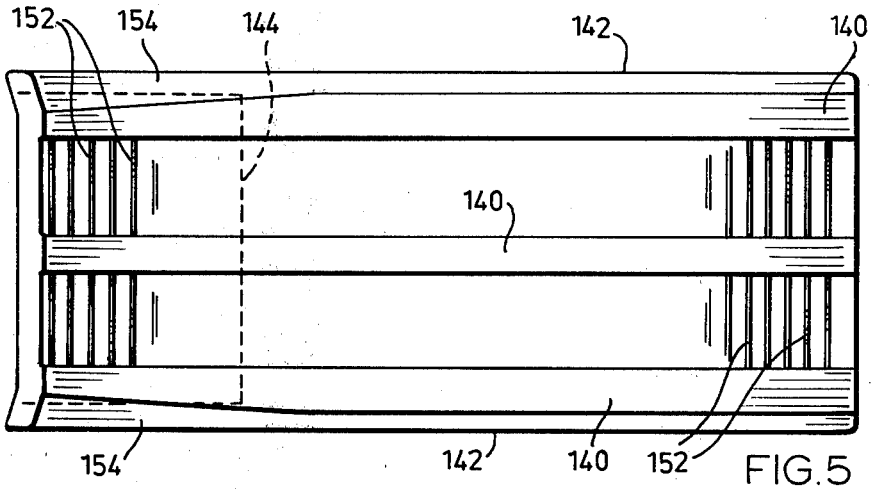
FIG. 5
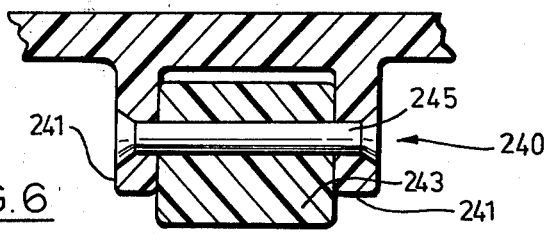
FIG. 6

AQUATIC TOBOGGAN SLIDE

This is a continuation, of application Ser. No. 174,757, filed Aug. 4, 1980, which is a continuation in part of application Ser. No. 025,795, filed Apr. 2, 1979 both abandoned.

This invention relates to aquatic toboggan slides, that is entertainment equipment in which toboggan-like vehicles are allowed to accelerate down a chute or slide into a body of water.

BACKGROUND OF THE INVENTION AND REVIEW OF THE PRIOR ART

Aquatic toboggan slides of the type outlined above are known in the art, being described for example in U.S. Pat. Nos. 1,399,469, issued Dec. 6, 1921 to Cucullu, 1,467,293 issued Sept. 4, 1923 to Matheson, and 1,497,754 issued June 17, 1924 to Howard. Equipment of the type disclosed in these patents is not to the best of applicant's knowledge currently in use in the recreational industry, and it is believed that the reasons for this are that the equipment presents a risk of injury to users which is unacceptable for present day commercial installations, it is to difficult and expensive to maintain in good working order, and its actual performance is somewhat unpredictable and largely beyond the control of the user. The objectives sought by the present applicant in the performance of his slide are similar to those sought by Cucullu, i.e. a rapid acceleration down the slide, followed by a planing over the surface of the water for a greater or lesser distance. In order to achieve this, Cucullu provides a slight upturn to the lower end of his chute so as to impart lift and a nose-up attitude to a toboggan leaving the chute. The toboggan will therefore fly through the air on leaving the chute until the action of gravity cancels the lift and causes the toboggan to fall back to water level. During this period, the nose-up attitude of the toboggan will tend to increase, because the weight of the rider will be concentrated towards the rear of the toboggan, and the air resistance to the forward movement of the toboggan will exert a turning moment about the combined centre of mass of the toboggan and rider. The net result of this is that the rear end of the toboggan will strike the water at an angle, producing the "ricocheting" action described by Cucullu. Unfortunately, the impact with the water will also tend to occur immediately beneath the point where the rider will be seated, and the resultant shock will thus be transmitted straight up the rider's spine, as well as applying considerable stress to the toboggan, which in Cucullu's slide is apparently of similar construction to traditional snow toboggans. The present applicant has experimented with the use of such toboggans on an aquatic slide, and has found that the impact with the water applies stresses which rapidly destroy a toboggan of conventional construction and are injurious to the rider.

The two remaining patents identified above both show slides which terminate at their lower ends in floating sections which are designed to discharge a toboggan level with the water surface. Although as drawn, both show end sections which are slightly upturned, it seems intended that the hinged floating end sections will dip under the combined effect of the weight of the toboggan and the reaction entailed in changing its direction as it rounds the curve at the lower end of the slide. This level discharge of the toboggan reduces the risk of injury but also probably suppresses the "ricochet" effect described by Cucullu; it is noteworthy that neither the Howard nor the Matheson patents describe such an effect. Moreover, wave effects acting on the discharge section will render the exact direction of discharge unpredictable.

As pointed out above, conventionally constructed toboggans are not really suitable for use on the type of slide with which the present invention is concerned, since they are neither strong enough nor afford sufficient protection to the rider. Moreover, they are not designed for optimum planing characteristics over water. In Canadian Pat. No. 236,089, issued Dec. 4, 1923, Matheson describes a toboggan specifically designed for aquatic use. A specially reinforced toboggan frame is covered by a watertight skin so as to provide extra rigidity and buoyancy. Whilst the extra buoyancy may be a convenience and a safety factor if the toboggan is used in deep water, the protection it affords against injury to the user is probably no better than in the case of a conventional toboggan. In particular, there is no protection against the transmission of water impact, and nothing to guard against the user's limbs contacting the slide.

In the arrangements discussed above, the slides employed utilize roller conveyors. Proposals have also been made to utilize wheeled toboggans on plain slides, although this has the disadvantages of making it difficult to streamline the bottom of the toboggan and increasing the cost of construction. Such toboggans are shown in Canadian Pat. Nos. 27,770 and 246,640 although it is not clear whether they are intended for aquatic use. Where roller conveyors are used, it is of course important to minimize frictional losses in the conveyor, and corrosion is a major problem. It is also important to provide a slide structure which minimizes the risk of injury to its users. The Howard and Matheson structures rely on engagement of wheels and rollers with the runners of the toboggan to provide lateral guidance, which carries the risk of derailment, particularly in view of the necessarily fairly light weight of the toboggans relative to that of the user, and both would be extremely hazardous in the event of a user falling off a toboggan. The Cucullu structure relies on shallow side walls for guidance but there is nothing to prevent hands or feet being trapped between a toboggan and the sides of the slide; although the structure is less hazardous than that of Howard or Matheson to an unseated rider, the wide spacing of the rollers, the shallow side walls and the roller bearing arrangements all present risks of injury. It is believed that the wide spacing of the rollers and wheels in all the structures may be intended to reduce frictional losses as well as the cost of the structure, but it will reduce the safety of the slide, increase the stresses on both rollers and toboggan, and provide a rough ride around the bottom curve.

SUMMARY OF THE INVENTION

The present invention seeks to provide an aquatic toboggan slide which represents a marked improvement over the prior art and overcomes the difficulties outlined above.

According to the invention an aquatic toboggan slide comprises the combination of a downwardly inclined chute, a plurality of toboggans dischargable down the chute, and a body of water adjacent the lower end of the chute; the chute being in the shape of a trough with continuous side walls and a load bearing low friction bed free of dangerous projections, said chute being configured and constructed so that a toboggan and rider discharged down it will be confined between the walls of the chute and acquire, by the time they leave the chute, a velocity of at least 35 feet per second, the lower discharge end of the chute being level and about 12 to about 20 inches above the surface of the body of water, and the curvature of the lower end of the chute being such that the rider of the toboggan will not be subjected to more than about 2 G; the body of water extending a distance in feet beyond the bottom of the chute which is at least about 3 times the velocity in feet per second at which a toboggan will leave the chute; each toboggan having a continuous bottom wall defining an undersurface inclined upwardly at its front end to a prow, raised side walls, a resilient seat member at the rear of the toboggan extending between the side walls and spaced from the bottom wall without being directly supported thereby, a leg space extending forwardly of the seat towards the prow of the toboggan, and hand grips extending from the toboggan structure within the side walls and to either side of the leg space.

By arranging that the chute discharges parallel with the water surface but 12–20, preferably 14–16 inches above the water level, the risk of excessive impact with the water is greatly reduced without spoiling the "ricochet" effect sought by Cucullu. The vertical component of motion of the toboggan when it hits the water will be limited to the velocity it acquires in falling 12–20 inches, and the initially level attitude of the toboggan as it leaves the chute will limit the turning moment due to air resistance. This turning moment will be to some degree controllable according to the attitude the user adopts on the toboggan, thus allowing the exercise of skill to achieve the optimum planing effect when the toboggan strikes the water.

Because the rider is sitting on a seat which is not directly supported on the bottom of the toboggan, much of the water impact is absorbed by the toboggan structure without being transmitted to the rider's spine. A further safety factor is provided by the use of a backless seat, this avoiding the risk of the rider being bounced onto the back of the seat. Preferably the toboggan is moulded from a synthetic plastic material such as polyethylene, and may incorporate a buoyancy chamber, preferably filled with foamed plastic.

An important feature of the toboggan is the positioning of the hand grips. Since these are within the side walls and to either side of the leg space, they ensure that both the user's legs and hands are kept within the toboggan, thus reducing the risk of injury during passage down the slide. The trough shape of the slide also contributes to this, as does the freedom of the load bearing bed of dangerous projections. This can conveniently be achieved by forming this bed of fairly closely spaced smooth surfaced rollers so that even a rider who has fallen off a toboggan should pass down the chute without suffering serious injury or falling through the structure.

It is preferred that the main part of the chute is disposed at a considerable angle to the vertical, preferably about 45° as compared to about 30° or less used in prior art structures. This has the advantages that the rate of acceleration of the toboggans is greater, so that the overall length of the chute and the space required for it is reduced, and where the bed is formed by rollers the number of rollers required and the load upon them is also reduced. On the other hand, the thrill to the rider is increased. The bottom curve of the chute where its transition to the horizontal occurs should be such as to avoid excessive centripetal loads on either the equipment or the rider, and loads should not exceed about 2 G.

The invention also extends to the chute and to the toboggans. A preferred chute construction utilizes a continuous unitary trough member having side walls and a central well beneath a bed of rollers extending laterally between longitudinally extending continuous bearing blocks secured to longitudinal support rails flanking the well. Such a structure involves no dangerous projections, and is easy to construct from corrosion resistant materials. The side walls of the trough should be substantially vertical to at least the level of the top of the side walls of the toboggans, and then flared outwardly.

Further features of the invention will be apparent from the following description of a preferred embodiment with reference to the accompanying drawings.

SHORT DESCRIPTION OF THE DRAWINGS

In the drawings:

FIG. 3 is a perspective view of a toboggan for use with the chute;

FIG. 4 is a transverse cross section through the toboggan of FIG. 3, near its rear end;

FIG. 5 is an underside plan view of an alternate embodiment of toboggan; and FIG. 6 is a fragmentary cross sectional view through a longitudinal rib of a toboggan.

DESCRIPTION OF THE PREFERRED EMBODIMENTS

Figure 1:
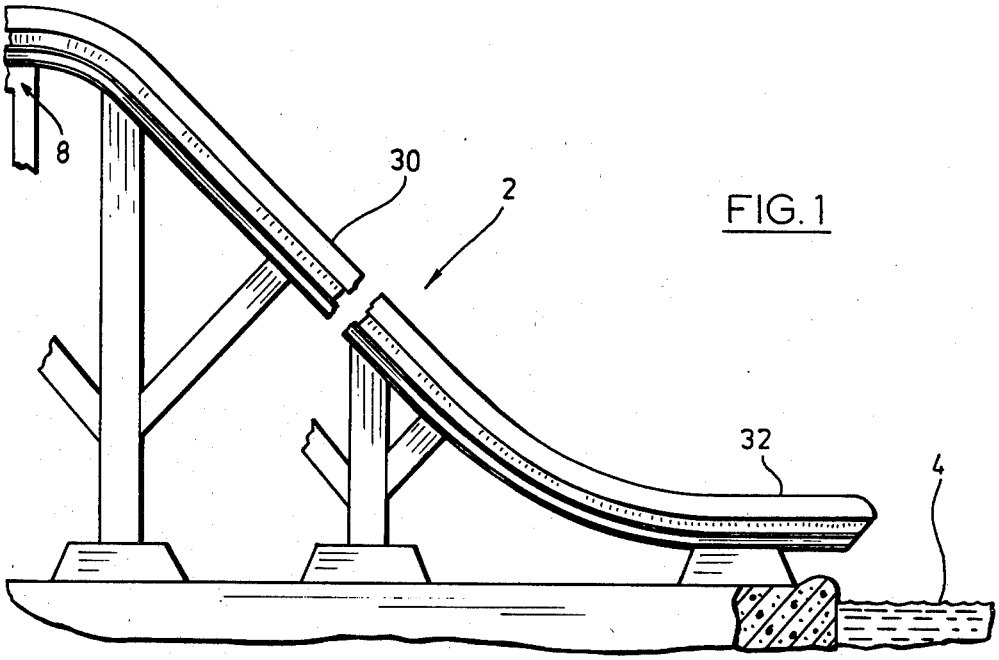
FIG. 1 is a side elevation of a chute employed in the aquatic toboggan slide of the invention.
Figure 2:
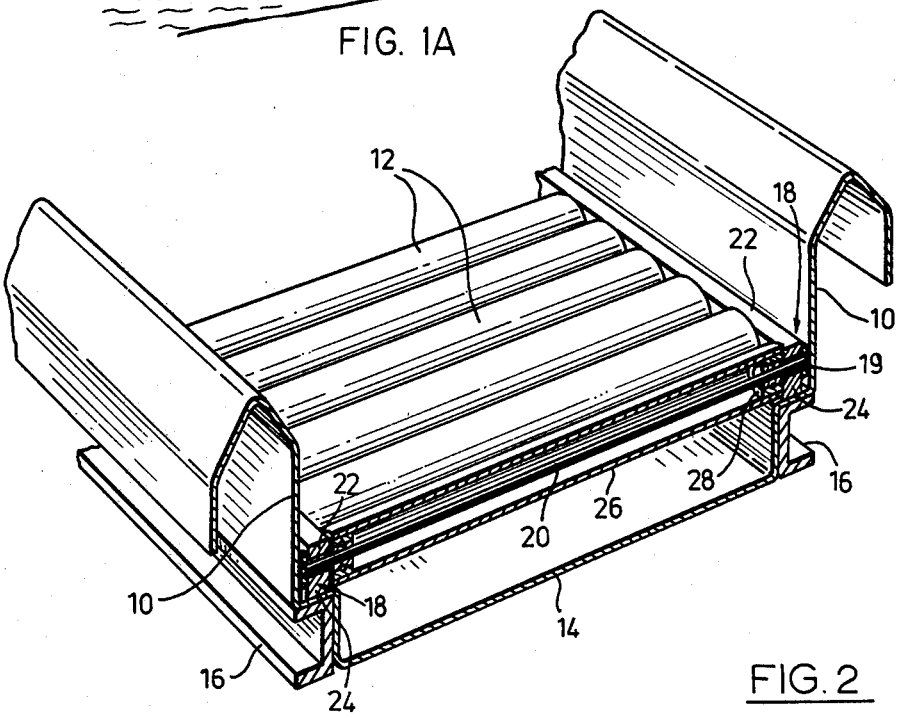
FIG. 2 is a section through the chute of FIG. 1 on the line 2—2.

A typical aquatic toboggan slide in accordance with the invention comprises a chute 2 and a body of water 4 as shown in FIG. 1 together with a number of toboggans 6 as shown in FIG. 3. Means (not shown) will of course be provided to enable the toboggans and their riders to reach a platform 8 at the top of the chute 2. The chute itself is trough shaped in cross section as seen in FIG. 2, with side walls 10 with down-turned reinforcing flanges and a load bearing bottom surface in the form of a bed of lateral rollers 12 extending across a well 14 formed integrally with the side walls 10. The side walls extend vertically above the roller bed to at least the height of the latter and are then flared outwardly to provide elbow room for riders of the toboggans. Typically the vertical portions are 8 inches high and the flared portions extend a further 5 inches. The well and side walls are preferably moulded in one piece from fibre reinforced synthetic resin so as to provide a smooth, strong, corrosion resistant unit. The moulding is supported to either side of the well by channel section support rails 16, to which are bolted continuous longitudinally extending bearing blocks 18 which support the ends of axle rods 20 of the rollers. At least one of the bearing blocks is split into upper and lower parts 22, 24 so as to permit rollers to be removed and replaced after the half 22 is removed. The bearing blocks may be of synthetic plastic, and the rollers themselves should be constructed of corrosion resistant materials. Thus the axle rods 20 may be of coated steel, the roller bodies 26 of plastic coated or sleeved steel, and the bearings 28 of plastic and/or stainless steel. The ends of the axle rods 20, which are preferably hexagonal in section, are located in the bearing blocks 18 by cylindrical bushes 19 having hexagonal bores and locating flanges external of the bearing block.

The resulting chute is light and strong in construction, and presents no dangerous projections or apertures on its inner surface. Typically, the side walls of the chute are about twenty-eight inches apart, and the rollers are 2–2.5 inches in diameter and are quite closely spaced at least around the bottom curve of the chute so as to provide a smooth ride and so as to avoid any opening through which a rider or his limbs could pass. Thus a rider should pass safely down the chute even after falling from a toboggan. The side walls 10 are higher than side walls of the toboggans thus making it extremely improbable that a toboggan can leave the slide accidentally.

The chute is configured so that there is an abrupt transition from the horizontal top platform 8 to a central portion 30 of the chute inclined at an angle of about 45° to the vertical, followed by a more gradual transition to a horizontal exit portion 32 of the chute positioned so that the top surface of the roller bed is parallel to and about 12–20 inches and preferably 14–16 inches above the surface of the body of water 4. The vertical drop down the chute is such as to provide a desired velocity at the exit portion, which velocity should be at least about 35 feet per second. Development of such a velocity requires a vertical drop of about 20 feet. A 32 foot vertical drop will theoretically provide an exit velocity of about 45 feet per second, assuming no losses through friction or air resistance occur; in practice for these reasons the velocity will be less than the theoretical although the steep slope and short length of the chute will minimize losses. When a toboggan descends such a chute, the rider will first feel an abrupt reduction to about one third of normal gravity as the toboggan drops down the chute, followed by an increase to well above normal gravity as the toboggan rounds the transition into the exit section of the chute. If the radius of this curve is about 16 feet, then the rider will be subject to a total force rising to the equivalent of about 2 G after which the toboggan will fly off the end of the chute and travel some feet through the air before striking the water. The water 4 extends beyond the bottom of the chute and in the same direction for at least about three times that distance in feet which corresponds to the velocity of the toboggan as it leaves the chute, i.e. about 135 feet in the example discussed, although about 150 feet is preferable. The behaviour of a toboggan 6 when it strikes the water is dependent on the structure of the toboggan, which will be discussed next.

The toboggan 6 shown in FIGS. 3 and 4 is formed by rotationally moulding from polyethylene a hollow body having upper and lower shells formed together as one piece, and injecting a foamable plastic material 35 to fill the interior. The lower shell forms a bottom wall 36 which provides a continuous lower planing surface with an inclined prow portion 38 at the front and longitudinally extending ribs 40 which assist the toboggan in planing in a straight line, stiffen the bottom wall, and engage the rollers 12. The bottom wall should be continuous so as to avoid the large openings which exist in many conventional toboggans since these generate excessive drag. The upper shell defines raised side walls 42, a raised seat portion 44, and a foot rest 46. Two hand grips are moulded into it within a well defined between the walls 42 and to either side of a leg space 50. The resulting double walled construction and the foamed filling 35 impart a degree of resiliency to the seat portion 44, which is not in any way directly supported on the bottom wall, whilst imparting strength and buoyancy to the toboggan. A typical toboggan is about two feet wide, four feet long, and six inches deep at the side walls. A rider mounting a toboggan at the platform 8 sits on the seat portion 44 and grips the hand grips 48, the rider's legs extending into the leg space 50 between the hand grips. The toboggan is then pushed forward onto the portion 30 of the chute which it descends as previously described. Since the rider's hands are within the walls 42 and the legs between the arms, there is no danger of limbs being trapped between the toboggan and the chute. When the toboggan strikes the water, the upturned prow prevents it from nosing under, and because of its high forward velocity, it will plane or hop over the water surface for a considerable distance. The angle of incidence with the water will affect its behaviour, and may be controlled to some extent after the toboggan leaves the slide by movement of the rider's centre of gravity. The resiliency of the seat portion protects the back of the user, whilst the construction of the toboggan provides it with the flexibility to resist impact without suffering damage. The backless construction of the seat portion 44 avoids the possibility of back injury should the rider be jerked rearwardly.

In an installation having several parallel chutes, it is desirable to divide the water into separate "lanes" by barriers to avoid the possibility of collision between toboggans from adjacent slides. The water should be deep enough in those areas where the toboggans are still travelling rapidly to avoid the risk of injury to riders falling off the toboggans; about four to six feet of water is satisfactory. The water may become gradually shallower at the side of the body of water opposite the chute or chutes to assist riders in leaving the water and to provide for "beaching" of toboggans which manage to plane for greater than usual distances.

FIG. 5 illustrates features of an alternative embodiment of toboggan which is of lighter and simpler construction. The upper shell is dispensed with except for the seat portion 144, which extends between side walls 142 integral with the bottom wall 136. Between and recessed relative to the longitudinal ribs 140 in the bottom surface are lateral ribs 152 of sawtooth form such as to stiffen the bottom surface, the sawtooth configuration being such as to provide a fluid bearing action enhancing the planing effect. Planing is further enhanced by the provision of inclined planing surfaces 154 between the side and bottom walls. A buoyancy element such as a slab of resilient plastic foam may be provided between the seat portion 144 and the bottom wall. The lateral ribs and planing surfaces may of course be incorporated in the toboggan of FIGS. 3 and 4, as may the feature shown in FIG. 6. FIG. 6 shows a longitudinal rib 240 in cross section, this rib structure replacing the ribs 40 or 140. THe rib comprises spaced side flange 241, between which a replaceable ribbing strip 243 is retained by cross pins 245 which may be bolts or countersunk rivets. It is the bottom of the ribs, in this case provided by the ribbing strips 243, that sustain the most wear and engender the most friction, and thus it is advantageous to be able to repair an otherwise serviceable toboggan by replacing the strips, which may if desired be made of lower friction and/or harder wearing material than the remainder of the toboggan, i.e. nylon. Since flexure of the toboggan structure during use means that the centre rib is subject to the most wear, only this rib need have a replaceable ribbing strip although preferably all of the ribs are so constructed.

Although it is preferred that the bed of at least the curve at the bottom of the chute is formed by closely spaced rollers so as to minimize frictional losses, rollers on the remainder of the chute may be more widely spaced provided that the gaps between them do not provide a major hazard, or the upper part of the chute could have a plain bed of low-friction material.

Figure 1A:
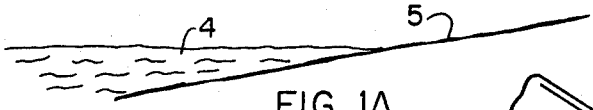
FIG. 1A is a section through the far side of a body of water located at the bottom of the chute.

A purpose built pool will normally be desirable to provide the body of water, since it is unlikely that any existing pool will be available having the desired characteristics, i.e. a sufficient extent beyond the bottom of the chute, sufficient but not excessive depth beneath the landing area of the toboggans, shallow water or a beach 5 at the limit of planing of the toboggans (see FIG. 1A), control of the water level relative to the lower end of the chute, and physical separation between portions of the water extending beyond adjacent chutes if more than one is provided.

What I claim is:

1. In an aquatic toboggan slide comprising the combination of a steeply downwardly inclined chute, a plurality of toboggans dischargable down the chute, and a body of water adjacent the lower end of the chute, the improvement wherein:

the chute is in the shape of a trough with continuous side walls and a load bearing bottom surface free of dangerous projections and formed by a plurality of parallel horizontal rollers extending laterally between the side walls, said chute providing a vertical drop of at least about 20 feet and the side walls extending higher than side walls of a toboggan so that a toboggan and rider discharged down the chute will be confined between the chute side walls, the lower portion of the chute being curved so that its discharge end is level and about 12 to about 20 inches above the surface of the body of water, and the curvature of the lower end of the chute being at least about 16 feet in radius, with the rollers being closely spaced at least in the curved lower portion of the chute;

the body of water extends a distance in feet beyond the bottom of the chute which is at least about three times the velocity in feet per second at which a toboggan will leave the chute; and each toboggan is moulded from synthetic plastics material, has a continuous bottom wall defining the longitudinally ribbed under surfaces inclined upwardly at its front end to a prow, raised side walls, a resilient backless seat member at the rear of the toboggan extending between the side walls and maintained spaced from the bottom wall by a filling of foamed plastic material, a leg space extending forwardly of the seat to, and including a foot rest near the prow of the toboggan, and individual hand grips extending from the toboggan structure and located inwardly of the side walls to either side of the leg space, and between the seat and the foot rest whereby to constrain a rider to assume a position with the rider's hands within the walls and the rider's legs between the rider's arms.

2. An aquatic toboggan slide according to claim 1, wherein the chute discharges about 14–16 inches above the water level.

3. An aquatic toboggan slide as claimed in claim 1, wherein the major part of the chute is disposed at about 45° to the vertical.

4. An aquatic toboggan slide according to claim 1, wherein the chute comprises a unitary continuous trough member having side walls deeper than the side walls of the toboggans and flared outwardly at their top edges, and a central well beneath a bed of closely spaced smooth surfaced rollers extending laterally between longitudinally extending continuous bearing blocks secured to longitudinal support rails flanking the well.

5. An aquatic toboggan slide according to claim 1, wherein each toboggan has spaced top and bottom walls, the interior being filled with foamed plastic material, the top wall defining the seat member, the leg space and the foot rest.

6. An aquatic toboggan slide according to claim 1, wherein the bottom wall of each toboggan is formed with sawtooth lateral ribs between the longitudinal ribs and is configured to provide a fluid bearing effect.

7. An aquatic toboggan slide according to claim 1, wherein the body of water becomes gradually shallower opposite the bottom of the chute and terminates in a beach forming a limit of planing of a toboggan discharged down the chute.

8. In an aquatic toboggan slide comprising the combination of a steeply downwardly inclined chute, a plurality of toboggans dischargable down the chute, and a body of water adjacent the lower end of the chute, the lower end of the chute being curved so that the toboggans leave the chute travelling slightly above and substantially parallel to the surface of the body of water, the improvement wherein each toboggan comprises a continuous bottom wall defining a longitudinally ribbed under surface inclined upwardly to a prow at its front end, raised side walls, an upper wall defining a resilient backless seat member at the rear of the toboggan extending between the side walls and spaced from the bottom wall by a filling of foamed plastic material, a leg space extending forwardly of the seat member and including a footrest close to the prow, and individual hand grips extending from the toboggan structure inwardly of the side walls, to either side of the leg space between the seat member and the footrest whereby to constrain a rider to assume a position with the rider's hands within the walls and the rider's legs between the rider's arms.

9. An aquatic toboggan slide according to claim 8, wherein the body of water becomes gradually shallower opposite the bottom of the chute and terminates in a beach forming a limit of planing of a toboggan discharged down the chute.

10. In an aquatic toboggan slide comprising the combination of a steeply downwardly inclined chute and a body of water adjacent the lower end of the chute, the improvement wherein:

the chute is in the shape of a trough with continuous side walls and a load bearing bottom surface free of dangerous projections and formed by a plurality of parallel horizontal rollers extending laterally between the side walls, said chute providing a vertical drop of at least about 20 feet and the side walls extending higher than side walls of a toboggan so that a toboggan and rider discharged down the chute will be confined between the chute side walls, the lower portion of the chute being curved so that its discharge end is level and about 12 to about 20 inches above the surface of the body of water, and the curvature of the lower end of the chute being at least about 16 feet in radius, with the rollers being closely spaced at least in the curved lower portion of the chute;

the body of water extends a distance in feet beyond the bottom of the chute which is at least about three times the velocity in feet per second at which a toboggan will leave the chute; and the chute comprises a unitary continuous trough member having side walls deeper than the side walls of the toboggans and flared outwardly at their top edges, and a central well beneath a bed of closely spaced smooth surfaced rollers extending laterally between bearing blocks secured to longitudinal support rails flanking the well.

* * * * *